US005549451A

United States Patent [19]

Lyda, Jr.

[11] Patent Number: 5,549,451

[45] Date of Patent: Aug. 27, 1996

[54] IMPELLING APPARATUS

[76] Inventor: Eldon L. Lyda, Jr., 201 Flat Creek Rd. Apt. No. 4, Athens, Tex. 75751

[21] Appl. No.: 278,932

[22] Filed: Jul. 22, 1994

Related U.S. Application Data

[63] Continuation-in-part of Ser. No. 986,453, Dec. 7, 1992, Pat. No. 5,332,355.

[51] Int. Cl.[6] ..... F04D 3/00

[52] U.S. Cl. ..... 415/218.1; 415/219.1; 415/74

[58] Field of Search ..... 415/74, 208.5, 415/218.1, 219.1, 220, 221; 60/221

[56] References Cited

U.S. PATENT DOCUMENTS

| | | | |
|---|---|---|---|
| 100,838 | 3/1870 | Andrews | 415/219.1 |
| 431,090 | 7/1890 | Waterhouse | 415/74 |
| 1,430,141 | 9/1922 | Angus | 415/218.1 |
| 1,874,450 | 8/1932 | Coats | 415/72 |
| 3,936,225 | 2/1976 | Stjernstrom | 415/218.1 |
| 5,266,009 | 11/1993 | Tasaki et al. | 415/218.1 |
| 5,332,355 | 7/1994 | Lyda, Jr. | 415/74 |

*Primary Examiner*—Edward K. Look
*Assistant Examiner*—James A. Larson
*Attorney, Agent, or Firm*—Gregory M. Howison

[57] ABSTRACT

A pumping device is provided having a housing comprised of an inlet housing (70) and a discharge housing (98). The inlet housing (70) contains an impeller device (80) that is comprised of a conical structure (82) rotatable about a rotational axis (86). The conical structure (82) has disposed thereon six vanes (84) that extend outward from the direction of the rotational axis (86). Helical vanes (74), (76) and (78) are disposed on the interior surface of the inlet housing (70). The impeller (80) is operable to rotate and force fluid outward against the interior surface of the housing (70), the vanes (74), (78) directing the fluid along the surface. The discharge section then redirects this to the outlet to prevent cavitation.

15 Claims, 6 Drawing Sheets

IMPELLING APPARATUS

CROSS-REFERENCE TO RELATED APPLICATIONS

This application is a continuation-in-part of Ser. No. 986,453, filed 12/7/93, now U.S. Pat. No. 5,332,355, entitled "Impelling Apparatus," which will issue on Jul. 26, 1994, which patent is incorporated herein by reference.

TECHNICAL FIELD OF THE INVENTION

The invention generally relates to devices for impelling fluids. More particularly, the invention relates to a device for impelling fluids, especially liquids, at relatively high flow rates and relatively low differential pressures by means of conically diverging rotating vanes operating within a conically diverging annular casing space.

BACKGROUND OF THE INVENTION

Conventional centrifugal impelling devices, such as pumps and compressors, utilize a set of rotating vanes, constituting an impeller, operating in a stationary casing. The rotating vanes accelerate the incoming fluid to a higher velocity. The fluid is discharged from the periphery of the impeller and the major portion of the velocity energy is then converted into pressure energy by means of the stationary casing. However, in certain specific applications, such as jet pump drives for watercraft, it is desirable to produce relatively low differential pressures and retain most of the velocity energy imparted to the fluid so that it may be expelled from the casing as a high velocity jet.

Centrifugal impellers are generally classified, according to the major direction of flow in reference to the axis of rotation, as radial flow, axial flow, or mixed flow. Mixed flow impellers combine radial and axial flow characteristics and are widely applied where relatively high fluid flow rates must be delivered at relatively low differential pressures. Such applications include, for example, the aforementioned jet pump drives for watercraft.

The phenomenon known as cavitation is of critical importance in impellers employed in liquid service and may be described as follows. As the liquid entering the impeller is accelerated by the impeller vanes, the pressure of the liquid drops suddenly due to the increase in velocity. Should the absolute pressure of the liquid at the impeller inlet drop below the vapor pressure of the liquid at the operating temperature, some of the liquid will vaporize and bubbles of vapor will be carried into the impeller. These vapor bubbles will collapse violently at some point downstream of the impeller inlet, usually within the impeller itself. The collapse of these vapor bubbles in the impeller produces excessive noise and vibration, and often physically damages impeller surfaces. In addition to the physical damage it causes, cavitation diminishes impeller performance and results in undesirable discharge pressure fluctuations as vapor bubbles form and subsequently collapse.

Attempts have been made to minimize cavitation by eliminating the sudden acceleration of the liquid as it enters the impeller. Screw type devices of gradually increasing diameter in the direction of flow, known generally as inducers, have been installed on impeller inlets. These devices gradually accelerate the liquid and induce it to rotate as it approaches the impeller vanes. The rapid shock acceleration associated with cavitation is thus reduced or eliminated.

Inducers are well suited for use on radial flow impellers which generally have defined inlet ports providing both space for the installation of an inducer and adequate clearance between the leading edge of the vanes and the face of the impeller. In contrast to radial flow impellers, mixed flow impellers generally lack defined inlet ports since the leading edges of the vanes often project forward from the impeller hub into the fluid flow stream. Consequently, inducers are not well suited for installation on mixed flow impellers.

Additionally, despite being somewhat successful in minimizing cavitation, inducers are a device which must be attached to conventional impellers and represent added manufacturing costs and an additional component which may require maintenance or replacement over time.

Therefore, there is a need for a mixed flow impelling apparatus which provides satisfactory performance while minimizing the likelihood of cavitation in liquid service.

SUMMARY OF THE INVENTION

The present invention disclosed and claimed herein comprises an impelling device for moving fluid which includes an impeller housing disposed adjacent a discharge housing. The impeller housing has a hollow interior with an inlet opening and an outlet opening and dimensioned such that the surface area at the inlet opening is less than the surface area at the outlet opening. The discharge housing also has a hollow interior with an inlet opening disposed adjacent the outlet opening of the impeller housing and an outlet opening. The discharge housing is dimensioned such that the surface area at the inlet opening is greater than the surface area at the outlet opening. An impeller is disposed within the impeller housing for moving fluid therethrough. The impeller comprises a rotatable impeller mass that is symmetrical and rotatable about a rotational axis and is disposed in the impeller housing. The impeller is dimensioned to reduce the volume between the rotatable impeller mass and the interior walls of the impeller housing as fluid flows from the inlet opening to the outlet opening of the impeller housing. A plurality of impeller vanes are disposed on the rotatable impeller mass and extending outward therefrom toward the interior walls of the impeller housing. These are operable to force fluid outward as the rotatable impeller mass rotates. A plurality of helical stator vanes are disposed on the interior walls of the impeller housing and are oriented in the direction of the rotation axis. These helical stator vanes extend from the inlet opening to the outlet opening of the inlet housing. A discharge device is provided in the discharge housing which has a rotatable discharge mass associated therewith. The rotatable discharge mass is operable to increase the volume between the exterior of the rotatable discharge mass at the interior walls of the discharge housing inlet opening to the outlet opening of the discharge housing as the fluid flows therethrough.

In another aspect of the present invention, the impeller housing is frustro-conical shaped. The rotatable impeller mass is conical shaped, having a base and an apex. The base thereof is disposed proximate to the outlet of the impeller housing and the apex thereof is disposed proximate of the impeller housing. The impeller vanes are flat and disposed perpendicular to the rotational axis extending outward from the surface of the conical shaped rotatable impeller mass. The outermost edge of the impeller vanes are disposed proximate to the innermost edges of the helical stator vanes.

In a further aspect of the present invention, the discharge mass is a conical shape that is provided with a plurality of helical discharge vanes disposed on the surface thereof and oriented in a direction opposite to the rotation of the rotational axis. The outermost edges of the discharge vanes are proximate to the interior surface of the discharge housing.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

The present invention provides a means for impelling fluids at relatively high flow rates and relatively low differential pressures. The device of the present invention imparts velocity energy to a fluid in a mixed radial and axial flow regime.

Figure 1:
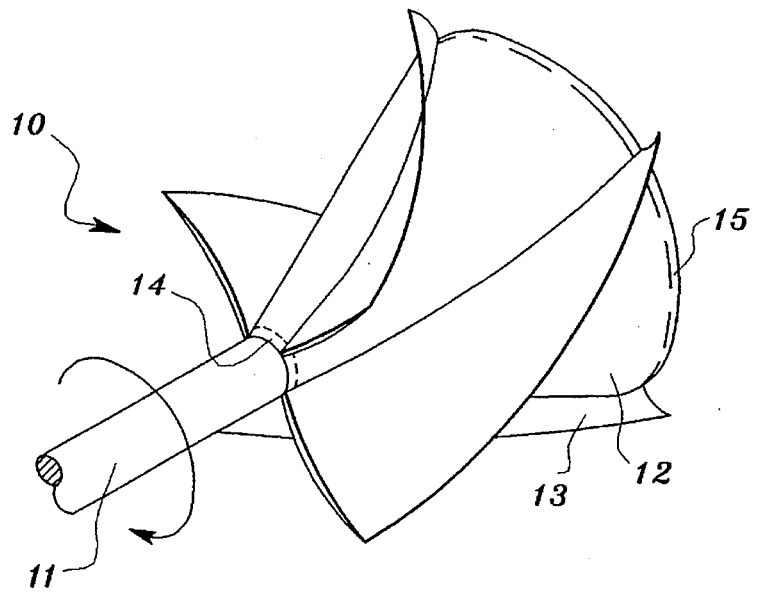
FIG. 1 is a view of the impeller comprising a shaft, impeller hub and multiple vanes.
Figure 2:
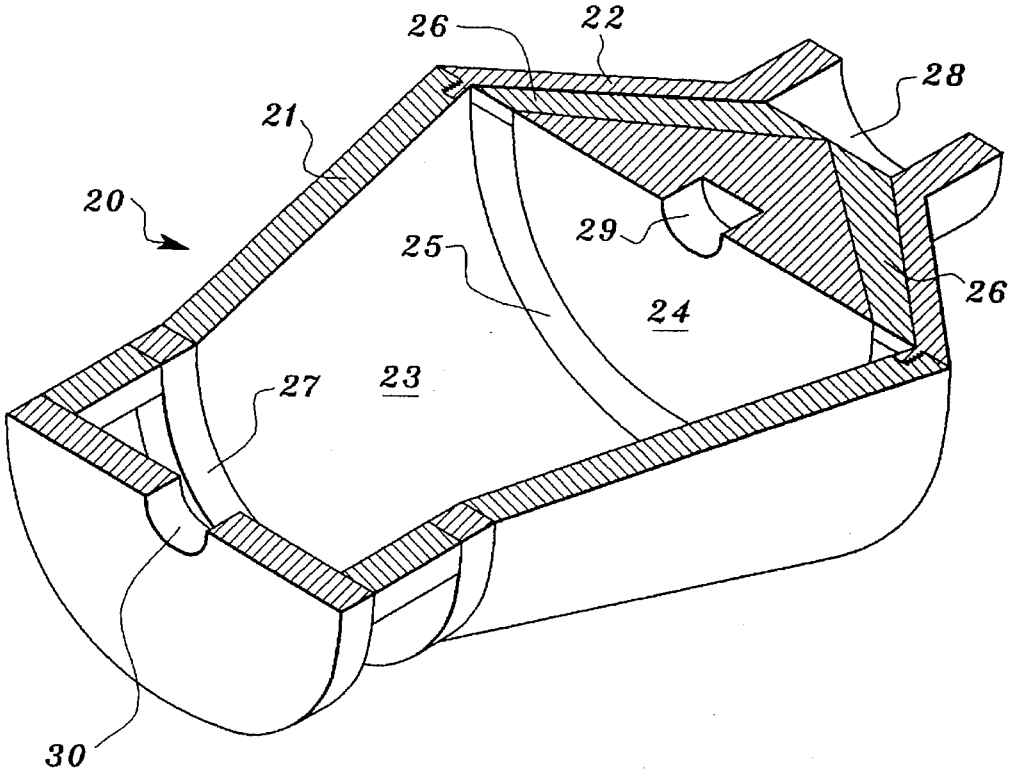
FIG. 2 is a sectional view of a casing for the impeller of FIG. 1.

FIGS. 1 and 2 show one embodiment of an impelling device which is formed of four major components: (1) an impeller 10 comprising a shaft 11 and a conical impeller hub 12 with vanes 13 mounted thereon; (2) a suction casing wall 21 forming a conically shaped suction cavity 23; (3) a discharge casing wall 22 forming a conically shaped discharge cavity 25; and (4) a stationary conical discharge hub 24. In general, impeller 10 is rotatably mounted within the conically shaped suction cavity 23 of casing 20 and shaft 11 is connected to a motor or driver (not shown) which rotates the impeller 10. The fluid enters the casing 20 through intake port 27 and advances both axially and radially along the rotating impeller hub 12. The fluid further advances through the annular space between the discharge casing wall 22 and the centrally mounted stationary conical discharge hub 24 and exits the casing 20 through discharge port 28 with a significantly increased velocity.

The impeller 10 comprises a shaft 11 on which a conically shaped impeller hub 12, with vanes 13, is mounted. To facilitate discussion, the impeller hub 12 is designated as having two sections, a "suction section" 14 which is that initial part of the impeller hub 12 which first contacts the fluid entering the intake port and a "transition section" 15 which is that part of the impeller hub 12 which is furthest from the suction section, i.e., where the fluid is in "transition" between the suction and discharge ends of casing 20.

An exemplary embodiment is shown in combined FIGS. 1 and 2. Here, the shaft 11 extends beyond the transition section 15 of the impeller hub 12 (extension not shown). The impeller 10 is rotatably mounted within casing 20 in the conically shaped suction cavity 23 and is supported by bearings 29 and 30, which may be of any suitable type.

Here, the casing 20 is designed so as to form two internal cavities: the conically shaped suction cavity 23, enclosed by suction casing wall 21, which diverges conically from the intake port 27, and the conically shaped discharge cavity 25, enclosed by discharge casing wall 22, which converges conically from suction cavity 23 towards discharge port 28. The stationary conical discharge hub 24 converges conically in a manner similar to discharge cavity 25 and is designed to fit within discharge cavity 25 with a predetermined annular space between the discharge hub 24 and the discharge casing wall 22. The discharge hub 24 is centrally mounted such that its axis is in line with the axis of impeller 10. The mounting is accomplished in this embodiment via stationary discharge vanes 26 which bridge the annular gap between the discharge hub 24 and the discharge casing wall 22. The diameter of the discharge hub 24 in the plane of its junction with the suction casing wall 21 is the same as the maximum diameter of impeller hub 12, i.e., the diameter of the impeller hub 12 at the end of the transition section 15.

In the embodiment as shown in FIGS. 1 and 2, the vanes 13 extend generally divergently along the outer surface of the impeller hub 12 and are of decreasing height along the length of the vane 13. Preferably, in this embodiment, the vanes 13 decrease in height such that the height at the transition section 15 is approximately 31% of the height at the suction section 14. "Divergently" relates to the direction and placement of the vanes 13 on or in relation to a conic structure, i.e., vanes 13 having the axial and radial components of a related conic structure.

FIG. 1 shows one embodiment of the vanes 13. Here, the vanes 13, towards the divergent end, are axially bowed back in a direction opposite that of the direction of rotation. Further, the vanes 13 have a helical twist, opposed to the direction of rotation. Still further, considering an incremental axial section of a vane 13, the vanes 13 are curved with a center of curvature to the left of the vane 13 as shown in FIG. 1 for the indicated direction of rotation.

The combination of FIGS. 1 and 2 generally illustrates a submersible pump according to the present invention. In use, the fluid enters intake port 27 and contacts the suction section 14 of impeller hub 12 and vanes 13. The shape of the rotating vanes 13, i.e., bowed back in a direction opposite that of the direction of rotation, causes the fluid to advance axially and radially along the conically shaped impeller hub 12. As the fluid approaches the transition section 15 of impeller hub 12, it is believed that the fluid has a significantly increased velocity without a significantly increased pressure. The fluid flows from the transition section 15 into the discharge cavity 25 and flows through channels defined by the annular space between discharge casing wall 22 and discharge hub 24 and between stationary discharge vanes 26. The fluid exits the casing at discharge port 28 with a significantly increased velocity.

Figure 5:
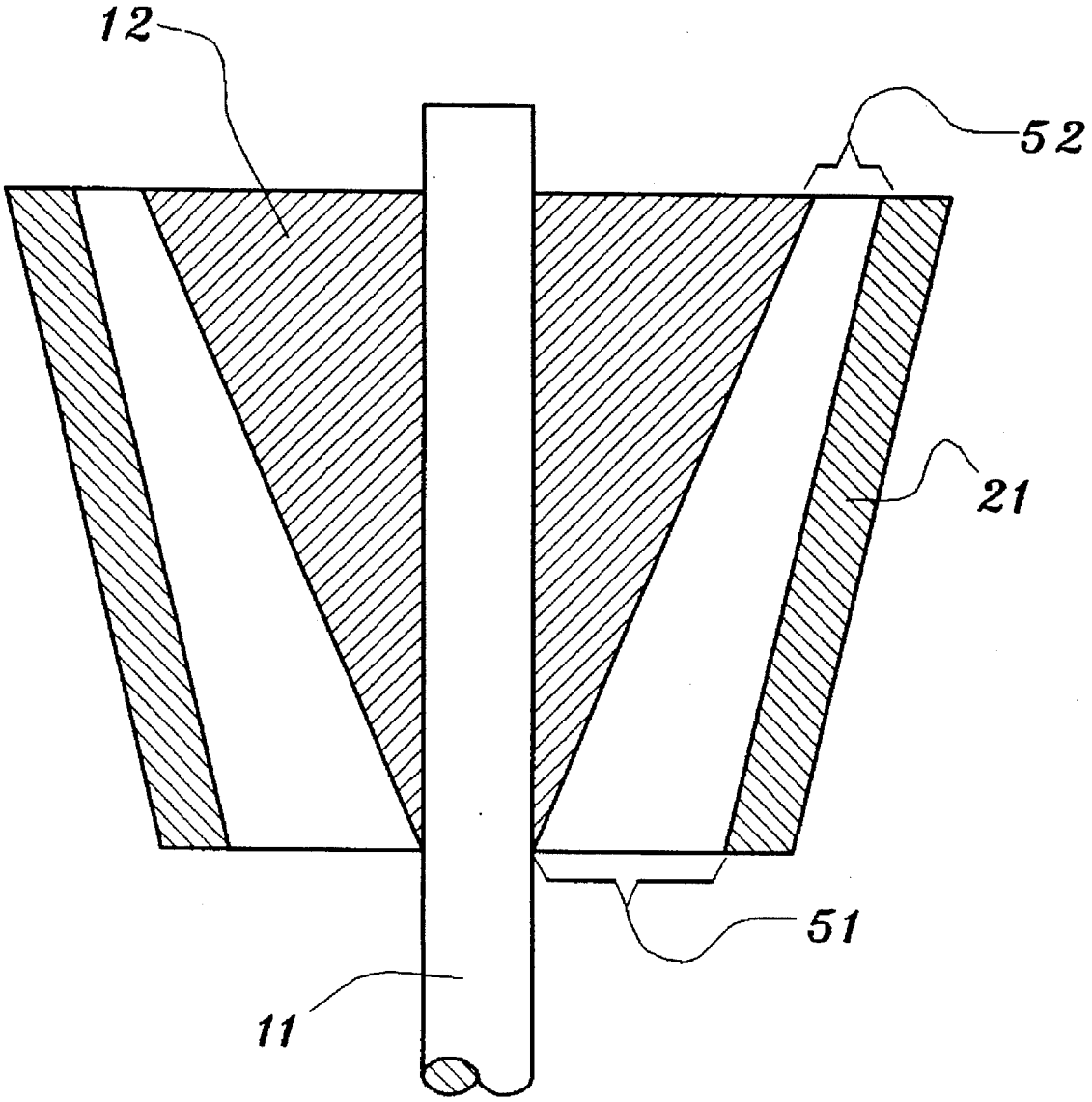
FIG. 5 is a schematic view of the impelling device showing the relationship between the impeller hub and the suction cavity at the suction section and at the transition section of the impeller hub.

The conically shaped suction cavity 23 and conically shaped impeller hub 12 are designed such that the incremental volume between the suction casing wall 21 and impeller hub 12 at the suction section 14 of the impeller hub 12 is greater than or equal to the incremental volume at the transition section 15 of the impeller hub 12, i.e., the cross-sectional area of the annular space between the suction section 14 of the impeller hub 12 and the casing 21 adjacent the suction section 14 is at least equal to the cross-sectional area of the annular space between the transition section 15 of the impeller hub 12 and the casing 21 adjacent the transition section 15. "Incremental volume" is the difference in cross-sectional areas between the inner surface of the suction casing wall 21 and the outer surface of the impeller hub 12 multiplied by an incremental length. "Incremental volume" may be better understood with reference to FIG. 5. The incremental volume at the suction section 14 (see FIG. 1) may be calculated by utilizing the suction section annular gap 51 to determine the cross-sectional area at the suction section 14. The cross-sectional area at the suction section annular gap 51 is multiplied by a unit length to calculate the incremental volume. It is believed that to reduce or eliminate cavitation, the incremental volume at the suction section annular gap 51 should be greater than or equal to the incremental volume at the transition section annular gap 52. It is believed that designing these elements such that the incremental volume at the suction section 14 is greater than or equal to the incremental volume at the transition section 15 will reduce the occurrence of cavitation.. It is believed that, if the incremental volume were allowed to increase from the suction section 14 to the transition section 15, cavitation would be more likely to occur.

As the fluid, pushed by rotating vanes 13, moves axially and radially along impeller hub 12 in the direction of flow, the fluid's velocity is increased due to the constant rotational speed and the fluid's increased distance from the axis of rotation, thus producing radial and axial acceleration. Because the impeller hub 12 diverges conically from the suction section 14, the incremental velocity of the vanes 13 increases from the suction section 14 to the transition section 15. Thus, the fluid is accelerated uniformly as it moves axially and radially from the suction section 14 to the transition section 15 of impeller hub 12. It is believed that uniform acceleration serves to reduce cavitation.

Figure 4:
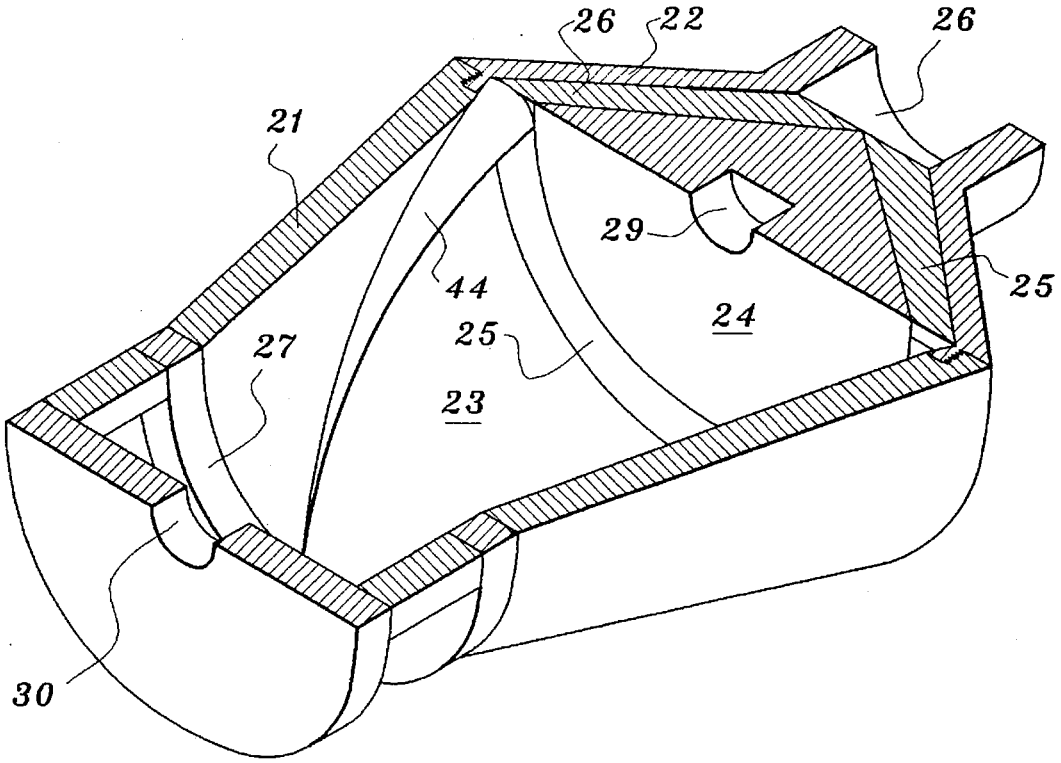
FIG. 4 is an alternate embodiment of the casing of FIG. 2, wherein the suction cavity contains multiple stator blades.

As the fluid proceeds past the transition section 15, the fluid is forced through channels defined by the annular space between discharge casing wall 22 and discharge hub 24 and between stationary discharge vanes 26. FIGS. 2 and 4 show one embodiment of the discharge vanes 26 wherein the discharge vanes 26 are generally straight in both the axial and radial directions. The discharge vanes 26 thus force the fluid into separate channels around the periphery of the discharge hub 24, effectively eliminating the rotational component of the flow. This discharge arrangement results in a high velocity discharge flow stream which is also highly directional.

Figure 3:
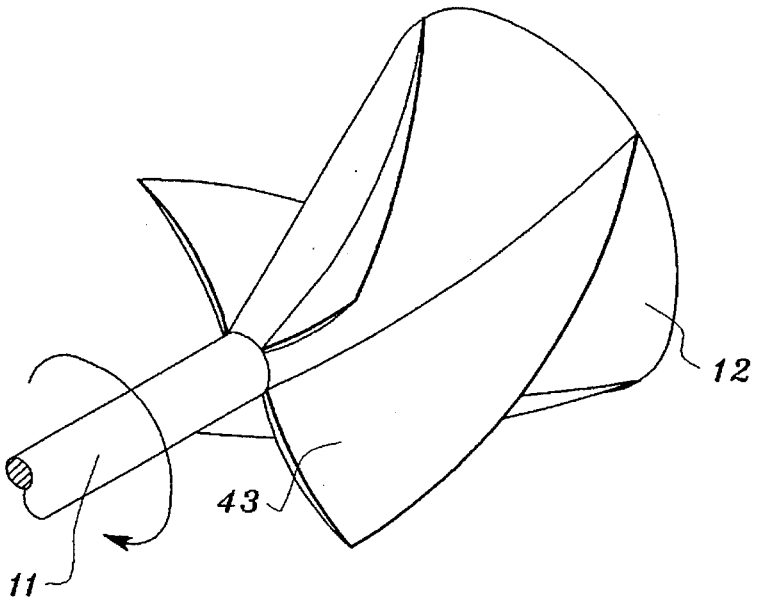
FIG. 3 is an alternate embodiment of the impeller of FIG. 1.

The present invention is also exemplified by an alternative configuration shown in combined FIGS. 3 and 4. This preferred embodiment is different from the previously discussed embodiment in regards to the shape of vanes 43 and the addition of stator blades 44. This embodiment would be used when a higher rate of flow and a higher velocity are desired. Here, the vanes 43 have the same general shape as the vanes 13 of FIG. 1 except that the height of the vanes 43 progressively decrease in the direction of flow such that the height of the vanes 43 decrease to zero at the transition section 15.

A plurality of stator blades 44 are attached to the interior of the suction casing wall 21 and protrude into the suction cavity 23. The stator blades 44 increase in height in the direction of flow and are designed such that their edges are in close proximity to the trailing edges of the rotating vanes 43. The stator blades 44 are attached to the inner surface of suction casing wall 21 in a generally divergent direction with a bow towards the divergent end, the bow being back in the direction of rotation. In relation to the inner surface of suction casing wall 21, the stator blades 44 are angled into the direction of rotation so as to scoop into the circular flow produced by rotating vanes 43. Considering an incremental axial section of a stator blade 44, the stator blades 44 are curved with a center of curvature to the right of the stator blade 44 as shown in FIG. 4 for the direction of rotation indicated in FIG. 3. Preferably, the stator blades 44 are located such that the divergent end is in-line with a corresponding discharge vane 26 in order to minimize turbulence in the transition section 15. (See meeting of stator blade 44 and discharge vane 26 in FIG. 4.)

The impelling apparatus of the present invention is a very versatile apparatus with varying embodiments employing the inventive concepts noted above.

The discharge cavity 25 and discharge hub 24 may be designed such that there is a progressively decreasing cross-sectional area in the annular space between the discharge casing wall 22 and the discharge hub 24 in the direction of flow such that the discharge configuration acts as a nozzle further increasing the fluid's velocity. This design would typically be used in a propulsion situation, such as a jet ski.

FIGS. 2 and 4 show casings 20 wherein the exterior shape is diverging conical to a middle section from the inlet and then converging conical from the middle section to the outlet. However, any exterior shape may be used, e.g., cylindrical.

The embodiments discussed thus far have a shaft 11 which extends through intake port 27. However, the shaft 11 could extend through discharge port 28, through discharge hub 24 (if discharge hub 24 is desired) to impeller hub 12. Such a configuration would be used for a "line shaft turbine" as are used in irrigation systems.

The embodiment of FIGS. 2 and 4 could be designed without stationary discharge vanes 26. In this circumstance, discharge hub 24 would be centrally mounted via other means. Also, the stationary discharge vanes 26 may be shaped such that the end at transition section 15 is curved into the circular flow produced by rotating vanes 13, 43, with the end toward discharge port 28 generally straight. This design would facilitate the conversion of rotational velocity to axial velocity.

For jet pump drives, such as for watercraft, the casing 20 could be designed without bearing 30 and the shaft 11 would be otherwise supported. This would allow water to enter intake port 27 with less obstructions.

The device of the present invention could be designed to facilitate piping connections to the intake port 27 and/or discharge port 28. In this circumstance, the device would operate as a pump.

The vane 13, 43 shape and size as well as the number of vanes 13, 43 could be altered depending upon the effect to be achieved. FIGS. 1 and 3 show one general shape of vanes 13, 43. However, the vanes 13, 43 may be shaped so as to achieve any predetermined objective. For example, the vanes 13, 43 may be shaped such that they are axially bowed back in a direction opposite that of the direction of rotation while being generally straight in the radial direction.

EXAMPLE

An impelling device was built and tested as follows:

The intake port 27 I.D. was 2.75 inches. The discharge port 28 I.D. was 2.75 inches. The diameter of impeller hub 12 at transition section 15 was 2.375 inches. The overall casing 20 length was 6.563 inches. The device had four stator blades 44 and four stationary vanes 26. Two embodiments of the device were tested; one embodiment having three vanes 13, the second embodiment having six vanes 13. Both the suction section and discharge section had an annular space of constant cross-sectional area.

Figure 6:
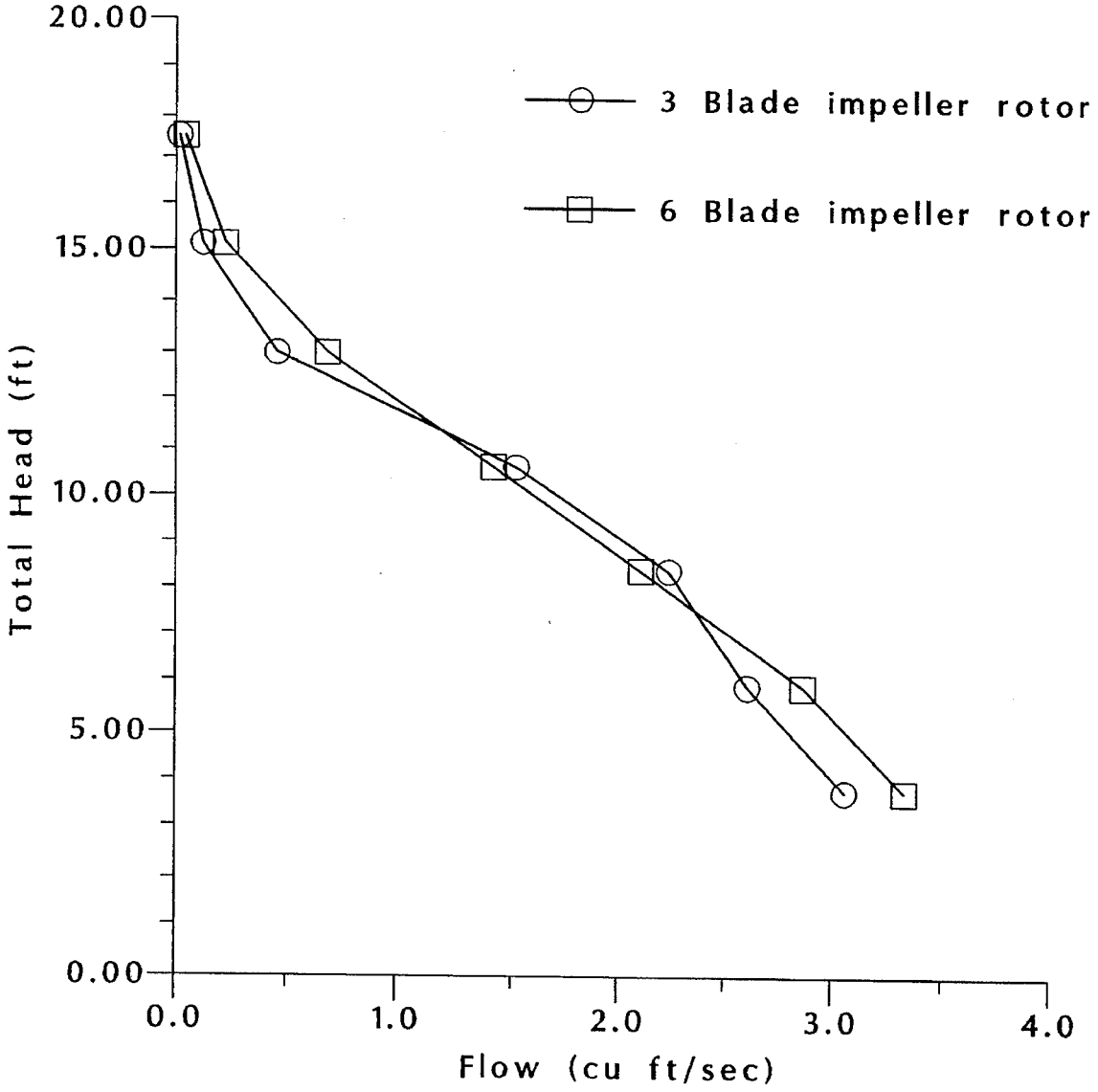
FIG. 6 is a graph of pump head versus flow rate for an impelling device of the present invention.

The device was submerged to a depth of four feet. The device was powered by a 1.5 horsepower electric motor with a maximum speed of 3450 RPM. The discharge of the device was routed through a 4 inch I.D. pipe to a level of 48 inches above the water surface. A valve was incorporated before the flow discharge with a pressure gauge located just upstream of the valve. The flow rate was determined for a number of discharge pressure settings (expressed in feet of head) as shown in FIG. 6.

Figure 7:
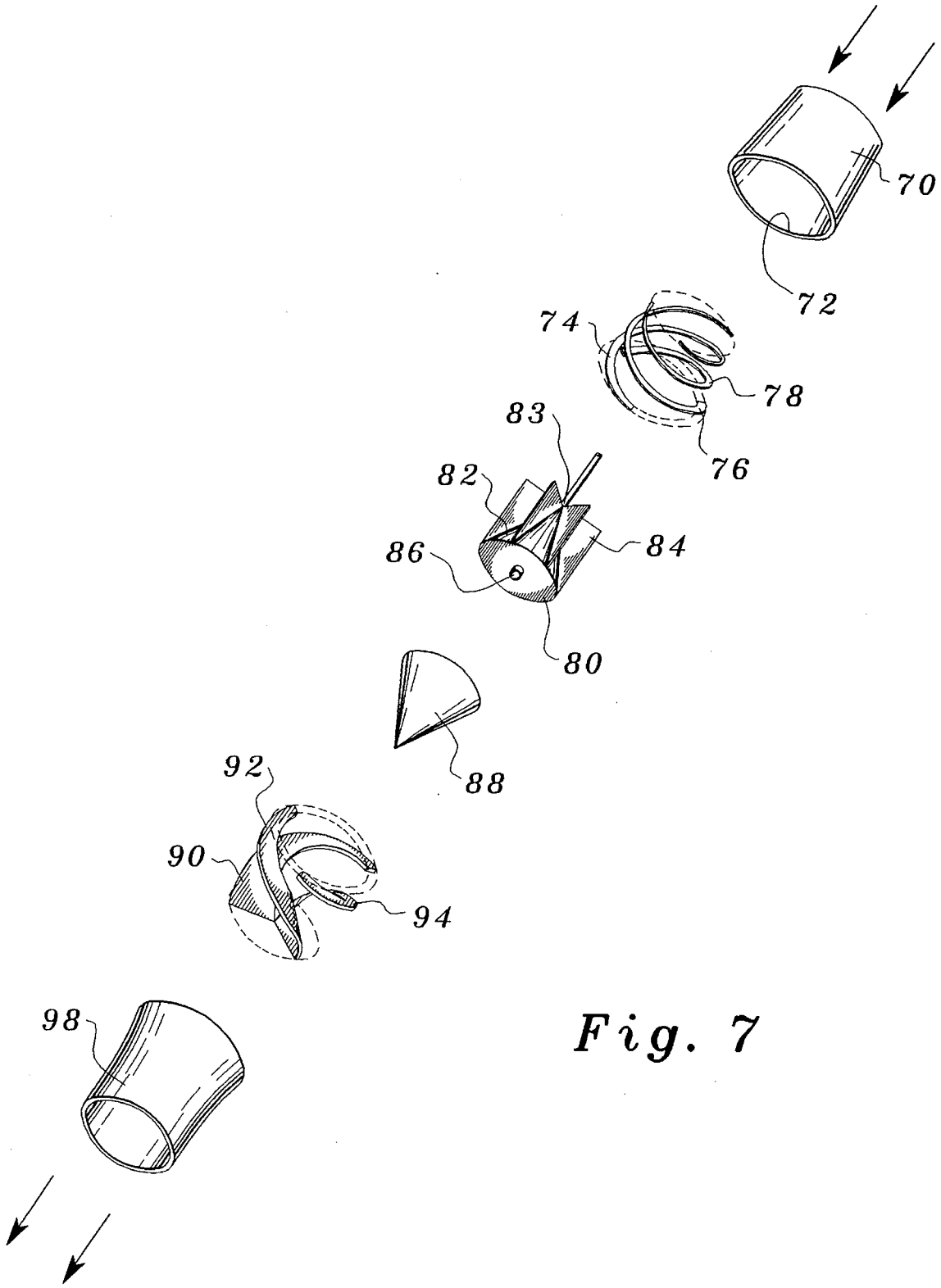
FIG. 7 illustrates an exploded view of a preferred embodiment of the present invention.

Referring now to FIG. 7, there is illustrated an exploded view of the preferred embodiment of the present invention. An inlet housing 70 is provided which has a frustro-conical shape with a hollow interior 72. The interior 72 tapers outward from the inlet side. Three helical vanes 74, 76 and 78 are disposed on the interior surface of the housing 70. Each of the helical vanes 74–78 are configured such that they have a narrow dimension extending into the housing 70 at the inlet end of the housing 70 and a wider dimension extending into the housing 70 at the outlet of the housing 70.

An impeller 80 is provided which is comprised a conical surface 82 and a plurality of vanes 84. The conical structure 82 extends from a point 83 proximate the end of the housing 70 to a base that is disposed toward the outlet of the housing 70 and is disposed about a rotational axis 86. Each of the vanes 84 are oriented such that they are perpendicular to a rotational axis 86 for the conical structure 82 and extend outward from the surface of the conical structure 82 to a distance that does not exceed the diameter of the base of the conical structure 82. There are provided six such vanes 84 disposed equally about the rotational axis 86. The conical structure 82 provides a rotational impeller mass.

A second conical structure 88 is provided that is similarly shaped to conical structure 82 and is disposed such that the base of the conical structure 88 is adjacent and rotatably attached to the base of the conical structure 82 and is disposed about the rotational axis 86. Three helical discharge vanes 90, 92 and 94 are provided that are disposed on the exterior surface of the conical structure 88. Each of the discharge vanes 90, 92 and 94 are configured such that they have a relatively narrow surface or width proximate to the base of the conical structure 88 and extending outward therefrom, and have a wider surface at the apex of the conical structure 88. Further, they are disposed at an angle to the surface of the conical structure 88 that is not perpendicular, but is aligned radially for its total length. An external housing on the outlet end, referred to as a discharge housing 98, is provided which is operable to be disposed down over the structure comprising the vanes 90–94, the conical structure 88, and contact the wider portion of the inlet housing 70. The interior walls of the discharge housing are attached to the discharge vanes 90, 92 and 94, such that the discharge vanes 90, 92 and 94 are disposed between the exterior surface of the conical structure 88 and the interior of housing 98. Therefore, the inlet housing 70 will contain the vanes 74 adhered and fixedly attached thereto and the impeller 80, while the discharge housing 98 will contain the conical structure 88 and the vanes 90–94 which are fixedly attached to the conical structure 88 and the interior surface of discharge housing 98.

Figure 8:
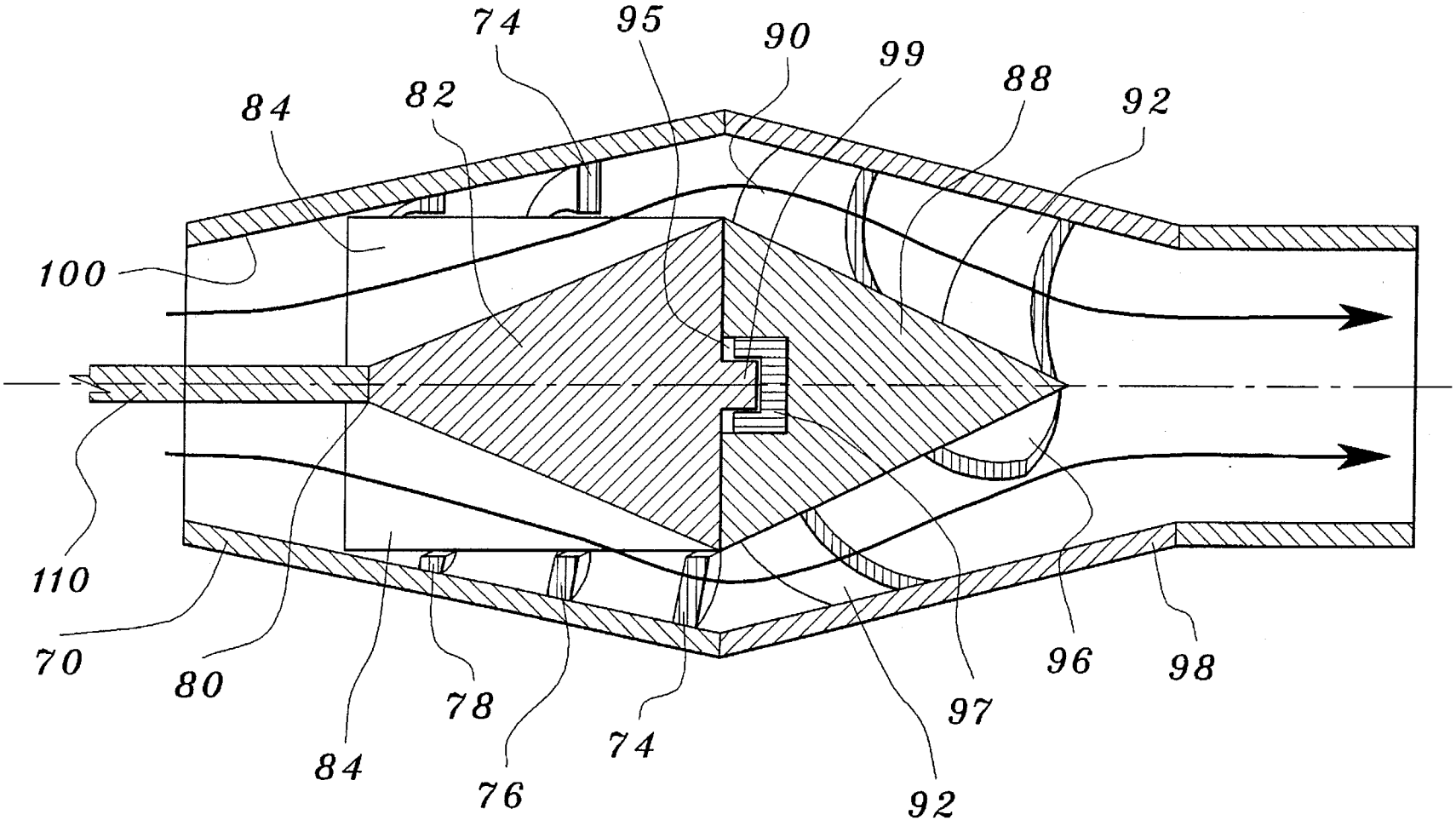
FIG. 8 illustrates a cross-sectional view of the assembly.

Referring now to FIG. 8, there is illustrated a cross-sectional diagram of the embodiment of FIG. 7 in an assembled view. Fluid is pulled into an inlet side 100 of the inlet housing 70 and urged outward by rotation of the impeller 80. The vanes 84, when they rotate, are operable to force the fluid outward. This causes the fluid to be directed against the vanes 74, which urge the fluid along the length of the apparatus. It is noted that, toward the inlet end 100, the helical vanes 74, 76 and 78 have a narrow dimension and have a small clearance between the outermost edge of the vane 84 and the innermost surface of the vane 78. Since the interior surface of the inlet housing tapers outward, and the outer surfaces or edges of the vanes 84 is substantially parallel with the rotational axis of the conical structure 80, the vanes 74–78 must become thicker in order to maintain the clearance. In general, the flow channel cross-sectional surface area at the inlet 100 is approximately seven square inches, which is reduced to a flow channel cross-sectional surface area of approximately 2.70 square inches at the widest portion of the conical structure 80 and the conical structure 88. When the fluid reaches the junction between the two conical structures 80 and 88, it is urged down along the interior surface of the discharge housing 98, which is also tapered, and through helical channels formed between the discharge vanes 90, 92 and 94, and thus forward. Again, the volume increases as the fluid flows from the juncture between the conical structures 82 and 88 and the actual outlet of the discharge housing 98.

A bearing pocket 95 is provided in the base of conical structure 88 with a bearing 97 disposed therein. A stub shaft 99 is disposed on the base of the conical structure 82 which is operable to be inserted into the bearing 97. Thus, the impeller rotates relative to the conical device 88. The channels formed between discharge vanes 90, 92 and 94 and the helical configuration thereof This will reduce any discharge cavitation. The volume increase between the inlet to the channels and the outlet therefrom provides for an efficient diffusion with reduced cavitation. A shaft 110 is attached to the impeller 80 for rotation thereof.

In general, the impeller 80 creates a rotation of a cylinder of fluid which is urged through the entire apparatus. The outer housings provide for containment of the trajectory of the discharge fluid with the discharge structure preventing or reducing cavitation of the fluid, thus improving the efficiency thereof. The helical vanes 74–78 each traverse the surfaces associated therewith by 360° or more and the helical vanes 90–94 each traverse the associated surfaces by at least 175° or more. As the rotor merely provides rotational motivation, it is the vanes 74–78 that initially provides the forward motive force. Therefore, the fluid actually rotates about the interior surface of the housings 70 and 98 under a positive force. The discharge section in the discharge housing 98 is operable to diffuse the fluid from the outer surface of the housing back to the center, this providing a nozzle effect to any negative forces due to diffusion.

In summary, there is provided a pumping device that is comprised of an inlet housing and a discharge housing that are combined together to form an entire housing. In the inlet housing, a tapered interior surface is provided that provides a frustro-conical shape. On the interior of the inlet housing are provided three helical vanes that extend around the surface thereof extending approximately 360° from inlet to outlet. They have a width that is narrow at the inlet end and wider at the outlet end. An impeller is disposed within the inlet housing having a conical shape with the wide portion disposed at the outlet of the inlet housing 70 and the apex thereof disposed toward the inlet side. Vanes are provided that extend outward from the conical surface having an edge that is substantially parallel with the rotational axis and they extend out to the diameter of the wide portion of the conical structure. The edge of the vanes is such that the most inward surface of the helical vanes is proximate to the exterior edge of the vanes. The outlet housing contains a discharge section which is comprised of a conical section. Vanes with a helical shape are disposed about the surface of the conical structure in the discharge portion and they have a width that is narrow at the inlet portion and become wider at the outlet portion of the discharge section.

Although the preferred embodiment has been described in detail, it should be understood that various changes, substitutions and alterations can be made therein without departing from the spirit and scope of the invention as defined by the appended claims.

What is claimed is:

1. An impelling device for moving fluid, comprising:

an impeller housing having a hollow interior with an inlet opening and an outlet opening, said impeller housing dimensioned such that the flow channel cross-sectional surface area at said inlet opening is less than the flow channel cross-sectional surface area of said outlet opening;

a discharge housing having a hollow interior with an inlet opening and an outlet opening, said discharge housing dimensioned such that the flow channel cross-sectional surface area at said inlet opening is greater than the flow channel cross-sectional surface area at said outlet opening, said inlet opening of said discharge housing connected to the outlet opening of said impeller housing; and an impeller disposed within said impeller housing, said impeller having:

a rotatable impeller mass symmetrical and rotatable about a rotational axis and dimensioned to reduce the volume between said rotatable impeller mass and the interior surface of said impeller housing as fluid flows from the inlet opening to the outlet opening of said impeller housing, and a plurality of impeller vanes disposed substantially parallel to said rotational axis on the exterior of said rotatable impeller mass and extending therefrom toward the interior walls of said impeller housing and operable to force fluid outward when said rotatable impeller mass rotates;

a plurality of helical stator vanes disposed on the interior walls of said impeller housing extending from the inlet opening thereof to the outlet opening thereof and in the direction of the rotational direction of said rotatable impeller mass and extending inward toward said impeller vanes; and a discharge device disposed in said discharge housing and having a conical discharge mass associated therewith and fixed relative thereto, said conical discharge mass proportioned to increase the volume between the inlet opening and the outlet opening of said discharge housing as the fluid flows therethrough.

2. The impelling device of claim 1, wherein the outlet opening of said impeller housing is substantially identical to the inlet opening of said discharge housing.

3. The impelling device of claim 1, wherein said impeller housing has an interior that is frustro-conical shaped.

4. The impelling device of claim 3, wherein said rotatable impeller mass is conical shaped having the base of said conical shape disposed proximate to the outlet of said impeller housing and the apex of said conical shape disposed proximate to the inlet of said impeller housing.

5. The impelling device of claim 4, wherein said impeller vanes are configured such that they extend outward from the surface of said conical shaped rotatable impeller mass having an outwardmost edge which extends substantially parallel to said rotational axis and does not exceed the diameter of the base of said conical shape.

6. The impelling device of claim 5, wherein said impeller vanes are substantially flat and disposed perpendicular to said rotational axis.

7. The impelling device of claim 5, wherein said helical stator vanes have a width that increases from a narrow width extending outward from the inner surface of said impeller housing proximate to the inlet of said impeller housing to a wider width that extends inward from the interior surface of said impeller housing proximate to the outlet end of said impeller housing and wherein the interior edges of said helical stator vanes are proximate to the outermost edges of said impeller vanes.

8. The impelling device of claim 4, wherein said helical stator vanes comprise three stator vanes, each traversing the interior wall of said impeller housing by at least 360° and each equally spaced from the other about the interior surface of said impeller housing.

9. The impelling device of claim 1, wherein said discharge mass further includes a plurality of helical discharge vanes that are disposed on said conical discharge mass and extend outward from the surface of the conical discharge mass with the outermost edges thereof attached to the interior surface of said discharge housing, such that helical channels are formed with said discharge housing having a flow channel cross sectional surface area at the inlet thereof that is less than the flow channel cross sectional surface area at the outlet thereof.

10. The impelling device of claim 9, wherein said helical discharge vanes are disposed at an angle to the rotational axis.

11. The impelling device of claim 5, wherein each of said impeller vanes has three edges, a first edge attached to the surface of said rotatable impeller mass, a second edge operating as a most distal edge and extending along the longitudinal axis of said impeller mass and a third edge disposed substantially perpendicular to the rotational axis and proximate the inlet opening.

12. The impelling device of claim 8, wherein each of said stator vanes has three edges, a first edge attached to the interior surface of said impeller housing, a second edge operating as a most distal edge and a third edge disposed substantially perpendicular to the rotational axis and proximate the outlet opening.

13. The impelling device of claim 12, wherein said discharge mass further includes a plurality of helical discharge vanes that are disposed on said conical discharge mass and extend outward from the surface of the conical discharge mass with the outermost edges thereof attached to the interior surface of said discharge housing, such that helical channels are formed with said discharge housing having a flow channel cross sectional surface area at the inlet thereof that is apportioned relative to the flow channel cross sectional surface area at the outlet thereof.

14. The impelling device of claim 13, wherein each of said discharge vanes has four edges, a first edge attached to the interior surface of said discharge housing, a second edge operating as a most distal edge, a third edge disposed substantially perpendicular to the rotational axis and proximate the inlet opening of said discharge housing and a fourth edge disposed substantially perpendicular to the rotational axis and proximate the outlet opening.

15. The impelling device of claim 14, wherein said third edge of said helical discharge vanes, and the third edge of said helical stator vanes are substantially equal in length and abut each other.

* * * * *

UNITED STATES PATENT AND TRADEMARK OFFICE

CERTIFICATE OF CORRECTION

PATENT NO. : 5,549,451

DATED : August 27, 1996

INVENTOR(S) : Lyda, Jr.

It is certified that error appears in the above-identified patent and that said Letters Patent is hereby corrected as shown below:

Column 2, line 49, delete "rotatable";

Column 2, line 50, delete "rotatable";

Column 2, line 51, delete "rotatable";

Column 8, line 32, delete "This";

Claim 13, column 10, line 53, delete "apportioned", and insert therefor --proportioned--.

Signed and Sealed this

Eighth Day of July, 1997

Bruce Lehman

*Attest:*

BRUCE LEHMAN

*Attesting Officer*

*Commissioner of Patents and Trademarks*